US008997504B2

(12) United States Patent
Ellis et al.

(10) Patent No.: US 8,997,504 B2
(45) Date of Patent: Apr. 7, 2015

(54) VENT ICE PREVENTION METHOD

(71) Applicant: Air Liquide Process & Construction, Inc., Houston, TX (US)

(72) Inventors: Bruce M. Ellis, Houston, TX (US); Minh Huy Pham, Houston, TX (US)

(73) Assignee: L'Air Liquide, Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 20 days.

(21) Appl. No.: 13/711,772

(22) Filed: Dec. 12, 2012

(65) Prior Publication Data

US 2014/0158206 A1 Jun. 12, 2014

(51) Int. Cl.

| | |
|---|---|
| ***F25D 21/00*** | (2006.01) |
| ***F25B 41/00*** | (2006.01) |
| ***F25D 21/12*** | (2006.01) |
| ***B08B 7/00*** | (2006.01) |

(52) U.S. Cl.

CPC ..... *B08B 7/00* (2013.01)

(58) Field of Classification Search

CPC ..... F25D 21/04; F25D 21/06; F25D 21/12; F25D 21/065; F25B 47/006; F25B 47/022

USPC ..... 62/80–82, 90, 122, 277, 282, 272

See application file for complete search history.

(56) References Cited

U.S. PATENT DOCUMENTS

| | | | | |
|---|---|---|---|---|
| 5,989,647 | A * | 11/1999 | Remy et al. | 427/446 |
| 7,228,715 | B2 * | 6/2007 | Brugerolle et al. | 62/643 |
| 2010/0275620 | A1 * | 11/2010 | Zurecki et al. | 62/80 |

* cited by examiner

*Primary Examiner* — Frantz Jules
*Assistant Examiner* — Steve Tanenbaum
(74) *Attorney, Agent, or Firm* — Justin K. Murray

(57) ABSTRACT

An improved vent ice prevention apparatus including a first conduit, a second conduit, and a third conduit, wherein the second conduit concentrically surrounds the first conduit thereby forming an annular region between the two conduits. The third conduit is in fluid communication with said annular region. The first conduit is configured to receive a cold vent stream, and the third conduit is configured to receive a dry purge stream and introduce the dry purge stream into the annular region in order to prevent ice formation.

21 Claims, 4 Drawing Sheets

VENT ICE PREVENTION METHOD

BACKGROUND

Ice buildup on gaseous cryogenic vents, for example cold compressor seal gas discharge vents, is a problem in many cryogenic plants. The function of vent lines can be defeated by the formation of ice (from condensed moisture in the ambient air) in the vent line. This can also be a safety issue, if a large piece of ice should fall from an elevated vent stack.

For example, FIG. 1 shows an example of the prior art. Cold vent conduit 12, which is transporting a cryogenic vent gas (which can be around −300° F.) is usually insulated by insulating conduit 14 in order to prevent ice build up around cold vent conduit 12. However, once the cryogenic gas exits cold vent conduit 12, moisture in the surround air begins to condense and freeze, first on the surface of the exit, and then slowly begins to build on itself until it ultimately forms ice formation 16. Eventually, ice formation 16 can close, thereby restricting the flow, which results in a large pressure drop and a less than efficient process. Operations personnel must then go outside to remove the ice, which takes time and subjects the personnel to possible harm. Therefore, a need exists in the industry for a simple and economical solution to this icing problem.

SUMMARY

An improved vent ice prevention apparatus including a cold vent stream disposed within a first conduit, wherein at least a portion of the first conduit is concentric with a second conduit, thereby producing an annular region, introducing a dry purge stream into a third conduit, wherein the third conduit is in fluid connection with the annular region, thereby preventing the first conduit from forming condensation or ice. In one embodiment, the cold vent stream is a cold stream originating from a compressor seal. In another embodiment, the dry purge stream is a dry stream originating from a warm compressor seal.

BRIEF DESCRIPTION OF THE FIGURES

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DESCRIPTION OF PREFERRED EMBODIMENTS

Figure 1:
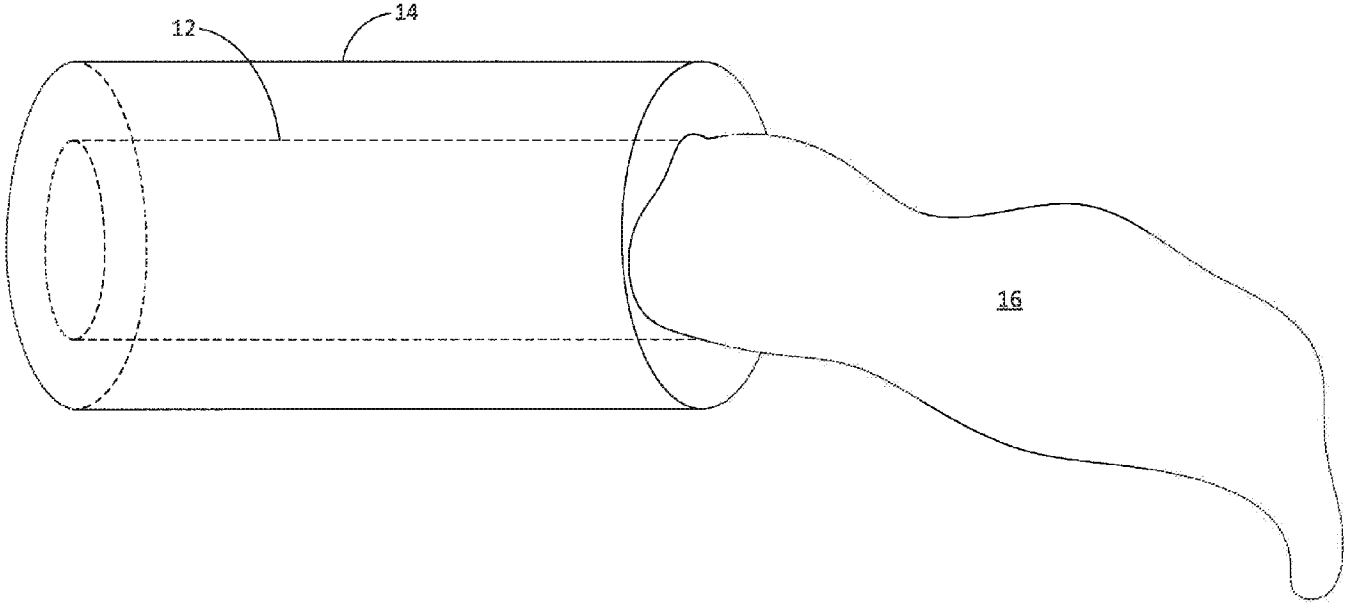
FIG. 1 (Prior Art)
FIG. 1 illustrates an embodiment of the prior art.

Illustrative embodiments of the invention are described below. While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

As used herein, the term "cold compressor" means a device for raising the pressure of a vapor in which both the inlet and discharge streams are below the freezing point of water.

As used herein, the term "warm compressor" means a device for raising the pressure of a vapor in which both the inlet and discharge streams are above the freezing point of water.

As used herein, the term "conduit" means any channel through which a fluid is conveyed. While the preferred embodiments show the conduits to be cylindrical in nature, it should be understood that the term conduit is not so limiting. Any shape that is suitable for conveying the fluid would be acceptable. As a non-limiting example, the first conduit can be a cylindrical pipe, while the second conduit could have a square cross section.

By inserting the first conduit inside a larger pipe (e.g., the second conduit) and discharging the dry, warm gas around the first conduit, the dry, warm gas displaces the wet atmospheric gas from the system and prevents the ice ball formation. Insulation is then only required from the cold vent stream's origin to the first conduit.

Other solutions have included a heating collar underneath installation but have not solved the problem effectively. As such, certain embodiments of the present invention can be practiced without the need for a heating collar. Therefore, the present solution is more effective and efficient than previous solutions, as it does not require a heating collar, which thereby saves energy costs and future maintenance. Embodiments of the present invention also provide a safety improvement as the vent is elevated (due to nitrogen purging) so the hazard of dropping ice onto personnel is eliminated. In the interest of clarity, element numbers are consistent between both figures.

Figure 2:
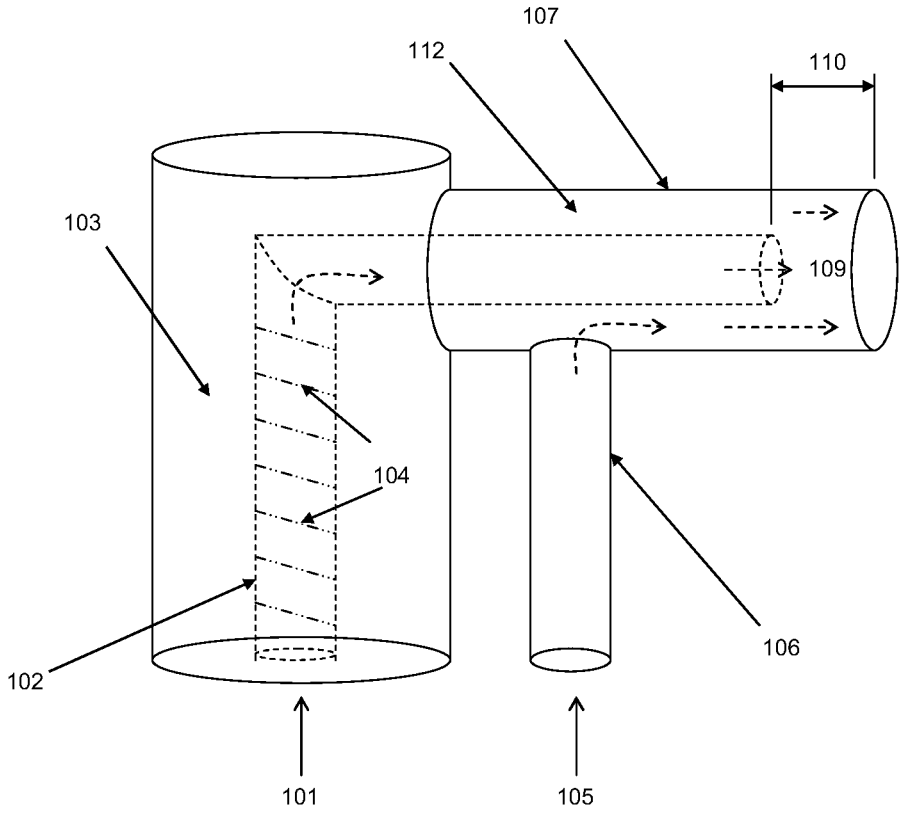
FIG. 2 illustrates one embodiment of the present invention.
Figure 3:
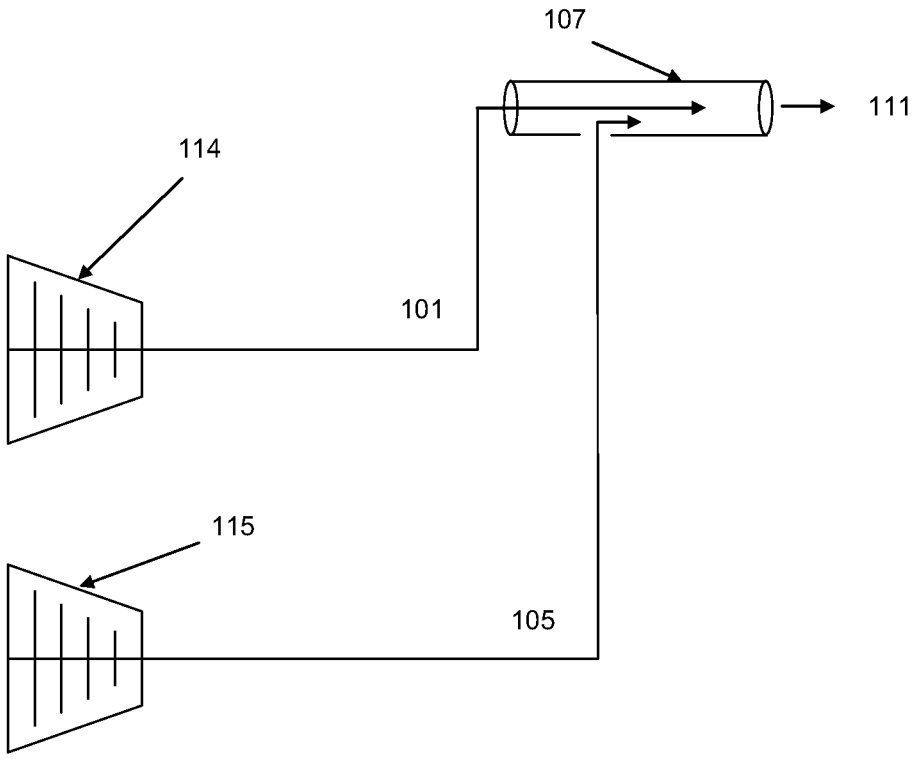
FIG. 3 illustrates another embodiment of the present invention.

Turning now to FIGS. 2 and 3, a cold vent stream 101 and a dry purge stream 105 are provided. Cold vent stream 101 may be the seal vent stream from a cold compressor 114. In one embodiment, cold vent stream 101 may be any cold gas, for example: air or nitrogen. In one embodiment, dry purge stream 105 may be the seal vent stream from a warm compressor 115. Dry purge stream 105 may be dry air, nitrogen, instrument air, or any other available dry vapor stream. In one embodiment, dry purge stream 105 is also warm (i.e., has a temperature over 32° F.)

Cold vent stream 101 may be directed through a first conduit 102. At least part of first conduit 102 may be heat traced 104, thermally insulated 103, or both. In one embodiment, at least part of first conduit 102 is concentric with a second conduit 107, thereby producing an annular region 112. Dry purge stream 105 may be directed through a third conduit 106, which intersects with second conduit 107. This allows dry purge stream 105 to flow through annular region 112 and thereby displace wet gas that was previously surrounding part of the exterior of first conduit 102 thereby surrounding the exterior with dry gas, which prevents ice formation. Cold vent stream 101 then combines with dry purge stream 105 to produce combined vent stream 109, which may be expelled into the atmosphere.

In one embodiment, combined vent stream 109 may have a mean temperature greater than 32° F. However, it is highly preferred that combined vent stream 109 be as dry as possible. The exit of the first conduit 102 may be recessed 110 from the exit of the second conduit 107. In one embodiment, the exit of the first conduit 102 may be recessed from the exit of the second conduit 107 by at least half the difference between the outside diameter of the second conduit 107 and the first conduit 102 ($(D_2-D_1)/2$). In one embodiment, the exit of the first conduit 102 may be recessed from the exit of the second conduit 107 by about 1 to about 5 inches. In another embodiment, the exit of the first conduit 102 may be flush with the exit of the second conduit 107.

Those of ordinary skill in the art will recognize that the appropriate amount of recess varies upon several factors, for example, flow rates of the cold vent gas and the dry purge gas, as well as overall humidity levels of the outside air, etc. . . . . As such, the optimum amount of recess cannot be specified as it would depend on these factors. Therefore, those of ordinary skill in the art will recognize that the distance of recess might need to be slightly adjusted depending on their own circumstances. Therefore, an effective amount of recess is any amount of recess that is effective in reducing or eliminating condensation or ice buildup on the device.

Figure 4:
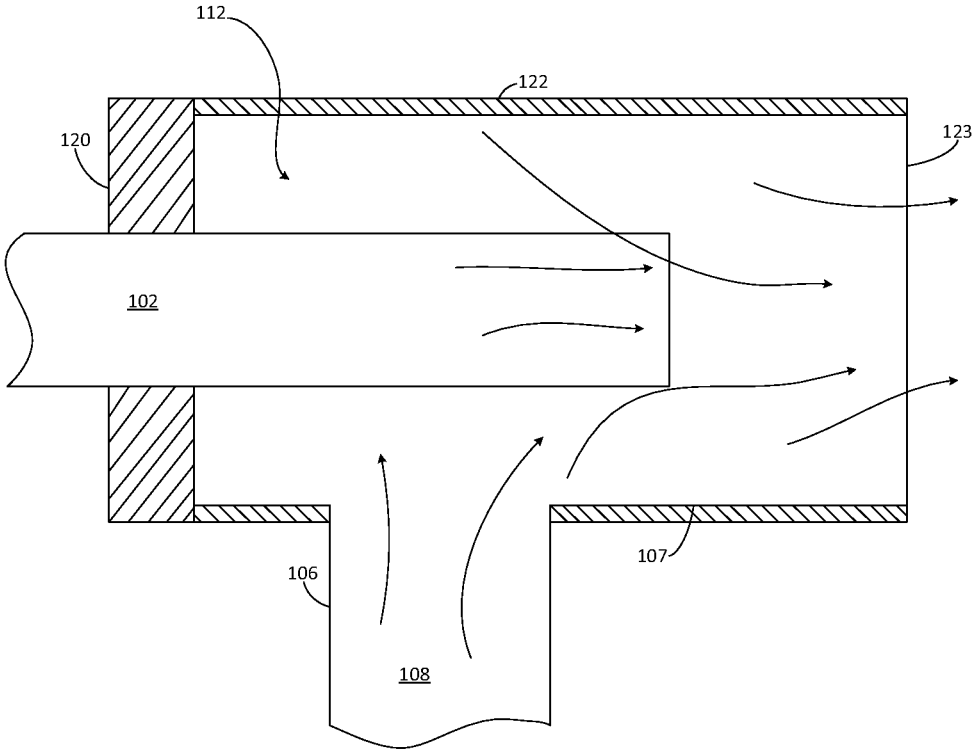
FIG. 4 illustrates a cross sectional view of an embodiment of the present invention.

FIG. 4 represents a cross sectional view of an embodiment of the present invention. In this embodiment, an insulated donut 120 is disposed distal from opening 123 of second conduit 107 and behind the entry point of third conduit 106 in order to promote movement of the amount of dry purge stream 105 towards the exit. In this embodiment, an insulating sleeve 122 is also provided to provide additional insulation for second conduit 107. A heating collar (not shown) can optionally be added; however, it is not necessary.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a non-exclusive listing i.e. anything else may be additionally included and remain within the scope of "comprising." "Comprising" is defined herein as necessarily encompassing the more limited transitional terms "consisting essentially of" and "consisting of"; "comprising" may therefore be replaced by "consisting essentially of" or "consisting of" and remain within the expressly defined scope of "comprising".

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

What is claimed is:

1. An improved vent ice prevention apparatus comprising:

a first conduit configured to receive a cold vent stream, the first conduit having an inlet and an outlet, wherein said cold vent stream comprises a cold stream originating from a cold compressor;

a second conduit surrounding at least a portion of the first conduit thereby creating an annular region between the second conduit and the first conduit, the first conduit having an inlet and an outlet; and a third conduit in fluid communication with the annular region, wherein the third conduit is configured to receive a dry purge stream and introduce the dry purge stream to the annular region, thereby preventing said first conduit or said second conduit from forming condensation and/or ice, wherein the first conduit and the second conduit are configured to expel the cold vent stream and the warm vent stream to the atmosphere at a direction that is substantially along the axis of the first conduit.

2. The improved vent ice prevention apparatus as claimed claim 1, wherein said cold stream comprises air.

3. The improved vent ice prevention apparatus as claimed in claim 1, wherein said cold stream comprises nitrogen.

4. The improved vent ice prevention apparatus as claimed in claim 1, wherein said dry purge stream comprises a dry stream originating from a warm compressor.

5. The improved vent ice prevention apparatus as claimed in claim 4, wherein said dry stream comprises dry air.

6. The improved vent ice prevention apparatus as claimed in claim 4, wherein said dry stream comprises nitrogen.

7. The improved vent ice prevention apparatus as claimed in claim 1, wherein the outlet of said first conduit is flush with the outlet of said second conduit.

8. The improved vent ice prevention apparatus as claimed in claim 1, wherein the outlet of said first conduit is recessed from the outlet of said second conduit.

9. The improved vent ice prevention apparatus as claimed in claim 8, wherein the outlet of said first conduit is recessed from the outlet of said second conduit by at least twice the outside diameter of the second conduit.

10. The improved vent ice prevention apparatus as claimed in claim 8, wherein the outlet of said first conduit is recessed from the outlet of said second conduit by about 1 to about 5 inches.

11. The in roved vent ice prevention apparatus as claimed in claim 1, wherein the outlet of said first conduit is recessed from the outlet of said second conduit an effective amount such that ice formation is reduced.

12. The improved vent ice prevention apparatus as claimed in claim 1, further comprising an absence of a heating collar disposed about the second conduit.

13. A method for reducing ice formation of a cryogenic vent, the method comprising the steps of:

introducing a cold vent stream into a first conduit, wherein a second conduit surrounds at least a portion of the first conduit thereby creating an annular region between the second conduit and the first conduit, wherein the first conduit has an inlet and an outlet, wherein the second conduit has an inlet and an outlet;

expelling the cold vent stream to the atmosphere at a direction that is substantially along the axis of the first conduit;

expelling the cold vent stream and the warm vent stream to the atmosphere at substantially the same location: and displacing wet air from the annular region by feeding a dry purge stream into the annular region through a third conduit, wherein the first conduit and the second conduit are configured to expel the warm vent stream to the atmosphere at a direction that is substantially along the axis of the first conduit, thereby preventing said first conduit or said second conduit from forming condensation and/or ice.

14. The method as claimed in claim 13, wherein the outlet of said first conduit is recessed from the outlet of said second conduit an effective amount such that ice formation is reduced as compared to if the outlet of said first conduit is flush with the outlet of said second conduit.

15. The method as claimed in claim 13, wherein the outlet of said first conduit is recessed from the outlet of said second conduit by about 1 to about 5 inches.

16. The method as claimed in claim 13, wherein the annular region has an absence of internal structure.

17. The method as claimed in claim 13, wherein the annular region comprises an absence of a porous media.

18. The method as claimed in claim 13, wherein the cold vent stream does not experience a substantial pressure drop upon exiting the first conduit.

19. The method as claimed in claim 13, wherein the first conduit comprises an absence of a nozzle at its exit.

20. The method as claimed in claim 13, wherein the first conduit is shaped such that the first conduit has a substantially constant cross sectional area, such that the fluid velocity within the first conduit is unaffected by the cross sectional area of the first conduit.

21. The method as claimed in claim 13, wherein the flow velocity of the cold vent stream is substantially constant throughout the first conduit.

* * * * *